US007642971B2

(12) United States Patent
Bolin

(10) Patent No.: US 7,642,971 B2
(45) Date of Patent: Jan. 5, 2010

(54) COMPACT DIVERSITY ANTENNA ARRANGEMENT

(75) Inventor: Thomas Bolin, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 237 days.

(21) Appl. No.: 11/754,040

(22) Filed: May 25, 2007

(65) Prior Publication Data

US 2008/0291103 A1 Nov. 27, 2008

(51) Int. Cl.
*H01Q 1/24* (2006.01)

(52) U.S. Cl. ..... 343/702

(58) Field of Classification Search ..... 343/702, 343/700 MS, 846, 742, 867
See application file for complete search history.

(56) References Cited

U.S. PATENT DOCUMENTS

| | | | | |
|---|---|---|---|---|
| 4,975,711 | A | 12/1990 | Lee | |
| 6,239,755 | B1 * | 5/2001 | Klemens et al. | 343/702 |
| 6,326,927 | B1 * | 12/2001 | Johnson et al. | 343/702 |
| 6,459,413 | B1 * | 10/2002 | Tseng et al. | 343/702 |
| 6,714,162 | B1 * | 3/2004 | Kadambi et al. | 343/700 MS |
| 7,030,833 | B2 * | 4/2006 | Ohara et al. | 343/867 |
| 2004/0056812 | A1 | 3/2004 | Sabet et al. | |
| 2007/0001911 | A1 * | 1/2007 | Fujio et al. | 343/700 MS |
| 2008/0284661 | A1 * | 11/2008 | He | 343/700 MS |
| 2009/0040113 | A1 * | 2/2009 | Tseng et al. | 343/700 MS |

FOREIGN PATENT DOCUMENTS

| | | | |
|---|---|---|---|
| EP | 1 770 874 | A1 | 4/2007 |
| WO | WO 2004/102744 | A1 | 11/2004 |
| WO | WO 2006/061352 | A1 | 6/2006 |

OTHER PUBLICATIONS

International Search Report issued for international application No. PCT/EP2007/062618 mailed Mar. 17, 2008, 4 pages.

* cited by examiner

*Primary Examiner*—Huedung Mancuso
(74) *Attorney, Agent, or Firm*—Harrity & Harrity, LLP

(57) ABSTRACT

The present invention relates to an antenna arrangement for a portable communication device as well as to a portable communication device comprising such an antenna arrangement. The antenna arrangement includes a ground plane, a first radiating electrical antenna element provided in a plane arranged at a distance above and parallel with at least part of the ground plane, where the first radiating electrical antenna element is dimensioned for resonating at least at one frequency, and a second radiating magnetic antenna element provided in the ground plane below the first antenna element and being dimensioned for resonating at the same frequency as the first radiating antenna element.

10 Claims, 3 Drawing Sheets

COMPACT DIVERSITY ANTENNA ARRANGEMENT

TECHNICAL FIELD OF THE INVENTION

The present invention relates to providing antenna diversity in wireless communication and more particularly to an antenna arrangement for a portable communication device as well as to a portable communication device having such an antenna arrangement.

DESCRIPTION OF RELATED ART

Mobile communication at high data rates, such as HSPA (High Speed Packet Access), demands the introduction of advanced radio communication link systems or equipment that better to the nature of radio wave propagation properties of wireless channels than communication at lower rates. One way to solve this is to introduce two or more antennas at either or both of the receiver and transmitter ends of a communication network. Antennas applied for these types of solutions are often termed diversity antennas, MIMO (Multiple Input Multiple Output) or MISO (Multiple Input Single Output) antennas. The configuration of such antennas has to offer some degree of independence, i.e. isolation, or un-correlation between the antennas. This is normally accomplished by physical separation of the antennas. This is however hard to implement at a portable communication device for the size of devices that are near or less than the wavelength of the radio-channel in use and this is the case for cellular phone handsets operating in the 800 to 2000 MHz bands.

Portable communication devices like cellular phones are thus very small. It is for many reasons also desirable to place the antennas of these devices inside the casing. This means that it is very difficult to provide a diversity solution in a portable communication device that has an acceptable isolation. The devices are thus often not large enough to obtain acceptable isolation. If an additional antenna element is provided, this will then also occupy additional space in the device, which may be very hard to provide because of the many other elements that it is desirable to provide in a small sized portable communication device.

It is therefore of interest to provide an antenna solution where more than one antenna operating at the same frequencies are provided in the same area, i.e. occupy essentially the same antenna volume while still being operating at the same frequencies with an acceptable isolation.

SUMMARY OF THE INVENTION

The present invention is generally directed towards providing an antenna arrangement that is small, can be provided inside a portable communication device and provides diversity.

A first aspect of the present invention is directed towards an antenna arrangement for a portable communication device comprising:

a ground plane, a first radiating electrical antenna element provided in a plane arranged at a distance above and parallel with at least a part of the ground plane, said first radiating electrical antenna element being dimensioned for resonating at least at one frequency, and a second radiating magnetic antenna element provided in the ground plane below the first antenna element and being dimensioned for resonating at the same frequency as the first radiating antenna element.

A second aspect of the present invention is directed towards an antenna arrangement including the features of the first aspect, wherein the first radiating antenna element is dimensioned for resonating at more than one frequency.

A third aspect of the present invention is directed towards an antenna arrangement including the features of the first aspect, wherein the first radiating antenna element is an electric dipole element.

A fourth aspect of the present invention is directed towards an antenna arrangement including the features of the third aspect, wherein the first radiating antenna element is a PIFA antenna element.

A fifth aspect of the present invention is directed towards an antenna arrangement including the features of the fourth aspect, wherein the first radiating antenna element comprises a number of branches connected to a feeding section, where at least some are dimensioned for resonating at separate frequencies.

A sixth aspect of the present invention is directed towards an antenna arrangement including the features of the first aspect, wherein the second radiating antenna element is a magnetic dipole antenna element.

A seventh aspect of the present invention is directed towards an antenna arrangement including the features of the sixth aspect, wherein the second radiating antenna element is provided as a slot in the ground plane for providing a slot antenna element.

An eighth aspect of the present invention is directed towards an antenna arrangement including the features of the seventh aspect, wherein the second radiating antenna element comprises a straight section provided between a feeding point and a first bend, where the distance between the bend and the feeding point corresponds to one resonating frequency of the second radiating antenna element.

A ninth aspect of the present invention is directed towards an antenna arrangement including the features of the seventh aspect, wherein the second radiating antenna element is a cavity backed slot antenna.

A tenth aspect of the present invention is directed towards an antenna arrangement including the features of the first aspect, wherein the ground plane includes at least two sections, a first section, which is provided under the first radiating antenna element and parallel with the plane in which said first radiating antenna element is provided, and a second section, which is perpendicular to the first section, and further comprising a third radiating magnetic antenna element in this second section of the ground plane.

An eleventh aspect of the present invention is directed towards a portable communication device comprising:

a ground plane, a radio circuit, a first radiating electrical antenna element provided in a plane arranged at a distance above and parallel with at least a part of the ground plane, said first radiating electrical antenna element being dimensioned for resonating at least at one frequency, and a second radiating magnetic antenna element provided in the ground plane below the first antenna element and being dimensioned for resonating at the same frequency as the first radiating antenna element.

A twelfth aspect of the present invention is directed towards a portable communication device including the features of the eleventh aspect, wherein the first radiating antenna element is dimensioned for resonating at more than one frequency.

A thirteenth aspect of the present invention is directed towards a portable communication device including the features of the eleventh aspect, wherein the first radiating antenna element is an electric dipole element.

A fourteenth aspect of the present invention is directed towards a portable communication device including the features of the thirteenth aspect, wherein the first radiating antenna element is a PIFA antenna element.

A fifteenth aspect of the present invention is directed towards a portable communication device including the features of the fourteenth aspect, wherein the first radiating antenna element comprises a number of branches connected to a feeding section, where at least some are dimensioned for resonating at separate frequencies.

A sixteenth aspect of the present invention is directed towards a portable communication device including the features of the eleventh aspect, wherein the second radiating antenna element is a magnetic dipole antenna element.

A seventeenth aspect of the present invention is directed towards a portable communication device including the features of the sixteenth aspect, wherein the second radiating antenna element is provided as a slot in the ground plane for providing a slot antenna element.

An eighteenth aspect of the present invention is directed towards a portable communication device including the features of the seventeenth aspect, wherein the second radiating antenna element comprises a straight section provided between a feeding point and a first bend, where the distance between the bend and the feeding point corresponds to one resonating frequency of the second radiating antenna element.

A nineteenth aspect of the present invention is directed towards a portable communication device including the features of the seventeenth aspect, wherein the second radiating antenna element is a cavity backed slot antenna.

A twentieth aspect of the present invention is directed towards a portable communication device including the features of the eleventh aspect, wherein the ground plane includes at least two sections, a first section, which is provided under the first radiating antenna element and parallel with the plane in which said first radiating antenna element is provided, and a second section, which is perpendicular to the first section, and further comprising a third radiating magnetic antenna element in this second section of the ground plane.

A twenty-first aspect of the present invention is directed towards a portable communication device including the features of the eleventh aspect, wherein it is a cellular phone.

The invention has a number of advantages. By providing a first radiating electric antenna element on top of a second radiating magnetic antenna element in a ground plane, the magnetic field of the second radiating magnetic antenna element is aligned with the electric field of the first radiating electric antenna element, and the electric field of the second radiating magnetic antenna element is aligned with the magnetic field of the first radiating electric antenna element. This improves the isolation between the radiating antenna elements even though they are provided in the same area. The antenna arrangement is furthermore provided in a small area which is normally already provided for a single antenna and thus the antenna diversity can be obtained with virtually no additional space. It is further simple and can be produced at a low cost.

It should be emphasized that the term "comprises/comprising" when used in this specification is taken to specify the presence of stated features, integers, steps or components, but does not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION OF EMBODIMENTS

Figure 1:
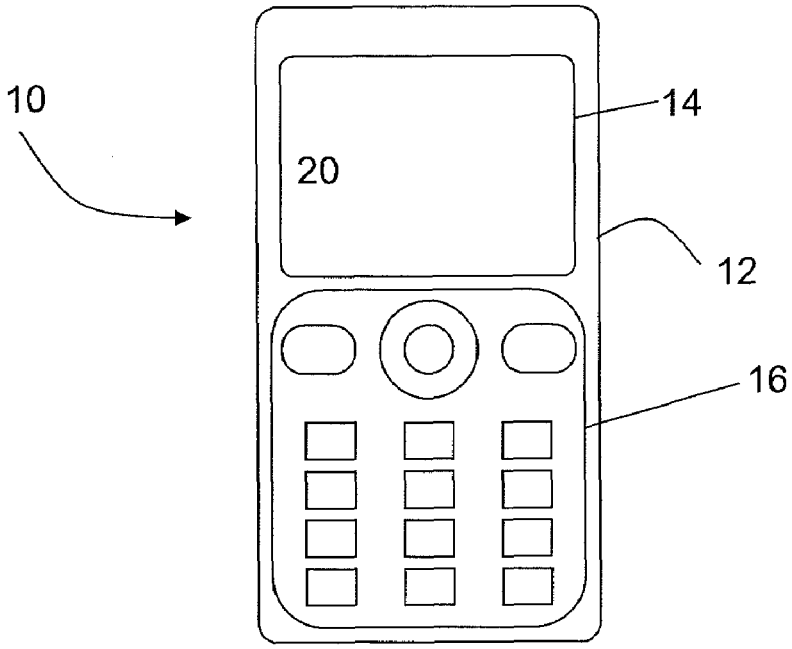
FIG. 1 shows a front view of a portable communication device in the form of a cellular phone.

Mobile communication at high data rates, such as HSPA (High Speed Packet Access), demands the introduction of advanced radio communication link systems or equipment that adopt better to the nature of radio wave propagation properties of wireless channels than communication at lower rates. One way to solve this is to introduce two or more antennas at either or both of the receiver and transmitter ends of a communication network. Antennas applied for these types of solutions are often termed diversity antennas, MIMO (Multiple Input Multiple Output) or MISO (Multiple Input Single Output) antennas. One end of a communication network may be provided through a portable communication device. The present invention is therefore directed towards providing antenna diversity in a portable communication device FIG. 1 shows a front view of a portable communication device 10 in the form of a cellular phone. The phone 10 has a casing 12 in which there is provided a keypad 16 and a display 14. The keypad here includes a number of keys that are used for operating the phone 10. The other different functional units of the phone 10 are provided in the interior of the phone 10, i.e. inside the casing 12. The phone 10 furthermore comprises at least one antenna arrangement, which according to the invention is provided in the interior of the phone, i.e. inside the casing 12. It should here be mentioned that the portable communication device according to the present invention is not limited to a cellular phone, but may be used in other portable communication devices like lap top computers or palm top computers.

Figure 2:
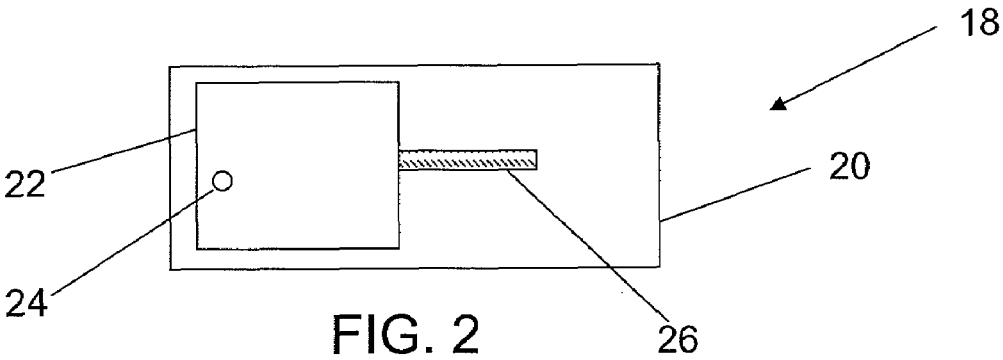
FIG. 2 shows a top view of an antenna arrangement according to a first embodiment of the present invention including a first radiating electrical antenna element provided above a ground plane including a second radiating magnetic antenna element.
Figure 3:
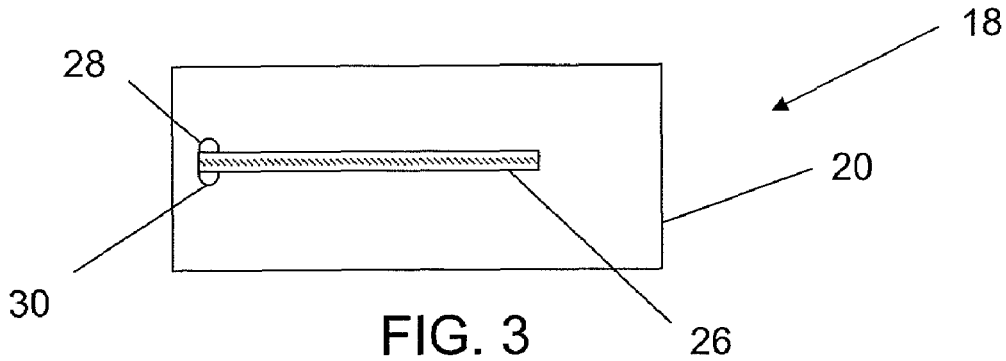
FIG. 3 shows a top view of the antenna arrangement according to the first embodiment but without the first radiating electrical antenna element.
Figure 4:
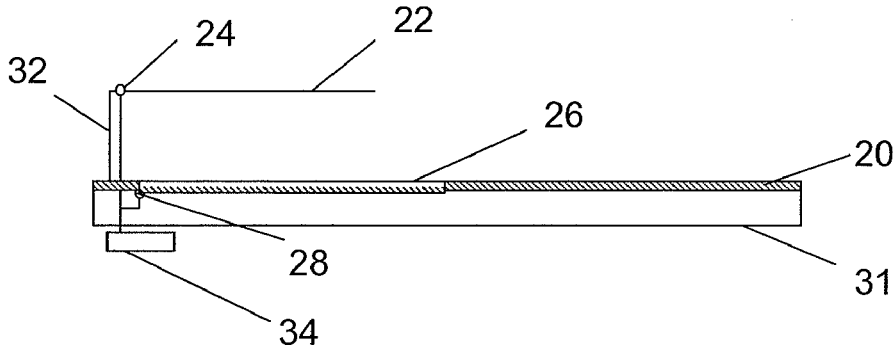
FIG. 4 shows a sectional view of the antenna arrangement in FIG. 2.

A first embodiment of the present invention will now be described in relation to FIGS. 2-4, where FIG. 2 shows a top view of an antenna arrangement 18 according to a first embodiment having a first radiating electrical antenna element 22 provided above a ground plane 20 including a second radiating magnetic antenna element, where FIG. 3 shows a top view of this antenna arrangement 18 but without the first radiating electrical antenna element and where FIG. 4 shows a sectional view of the antenna arrangement being connected to a radio circuit 34.

The antenna arrangement 18 thus includes a first radiating electrical antenna element that is here a PIFA element 22. The antenna arrangement 18 also includes said ground plane 20, which is provided on a substrate 31. The first radiating antenna element 22 is provided in a plane arranged at a distance above and parallel with at least a part of a ground plane 20. One end, the left end in the figures, of the PIFA element is here joined with the ground plane 20 and the element 22 is also provided with a connection 24 to a conductor that in turn connects to the radio circuit 34. In the first embodiment the first radiating antenna element 22 is dimensioned to be resonating at one frequency and here a frequency in a GSM frequency band, for instance 850/900 MHz. The length of the element normally corresponds to a quarter of a wavelength of the resonance frequency, while the distance to the ground plane influences the wideband properties of this first element 22. The antenna arrangement 18 also includes a second radiating magnetic antenna element, which is here a slot antenna element 26. This second radiating antenna element 26 is provided in the ground plane 20 directly underneath the first radiating antenna element and is thus provided in a plane parallel with the first antenna element 22. It is furthermore aligned with the first radiating antenna element 22. The slot 26 is here shown as being straight. It should however be realised that it can have any other shape, for instance have a meandering shape. The slot 26, which is here bounded by the ground plane 20 on all sides, has a length that corresponds to half the wavelength of the desired resonance frequency, which is the same frequency as the first radiating antenna element is dimensioned for resonating at. It should here be realised that the slot may be open ended, i.e. one side of the slot 26 will then not be bounded by the ground plane. In this case another length of the slot provides the desired resonance. The slot 26 is furthermore connected to a signal conductor and to ground via two connection points 28 and 30 provided on at the bottom of the slot 26 at each side of the slot walls in the longitudinal direction. This position of these connection points is thus a feeding point of the slot 26. They may be provided in the form of a bridge conductor. The connection points 28 and 30 are in this first embodiment provided at the furthermost left end of the slot 26. However, they may be provided at other positions along the length of the slot in order to provide a feeding point at another position. Both the signal connections 24 and 28 for the two antenna elements 22 and 26 are connected to a signal conductor that leads to a radio circuit 34, which may be provided on the opposite side of the substrate. The radio circuit 34 provides signals to the antennas for transmission and also receives signals from the two radiating antenna elements 22 and 26.

By providing an electric antenna element on top of a magnetic antenna element, several advantages are obtained. With this orientation of the radiation antenna elements in relation to each other, the magnetic H-field of the magnetic antenna element 26 is essentially parallel with the electric E-field of the electric antenna element 22, and the E-field of the magnetic antenna element 26 is essentially parallel with the H-field of the electric antenna element 22. This means that the isolation between the antenna elements will be fairly good and therefore it is possible to use the two antenna elements simultaneously at the same frequency and thus antenna diversity is obtained. This diversity is furthermore mostly important for the reception of signals than the transmission. The antenna arrangement is furthermore provided in a small area which is normally already provided for a single antenna and thus the antenna diversity can be obtained with virtually no additional space. The antenna volume provided for the first electrical radiating antenna element 22 is thus also used for the second radiating magnetic antenna element 26. The antenna arrangement according to the present invention is most advantageous at the lower frequency bands, for instance the 850 MHZ band, because there the size of the antenna elements is a major issue. The invention therefore provides a small sized antenna arrangement that can be provided inside a portable communication device and still have good antenna properties for a wide frequency range. It is further simple and can be produced at a low cost It also occupies a limited space in the device.

Figure 5:
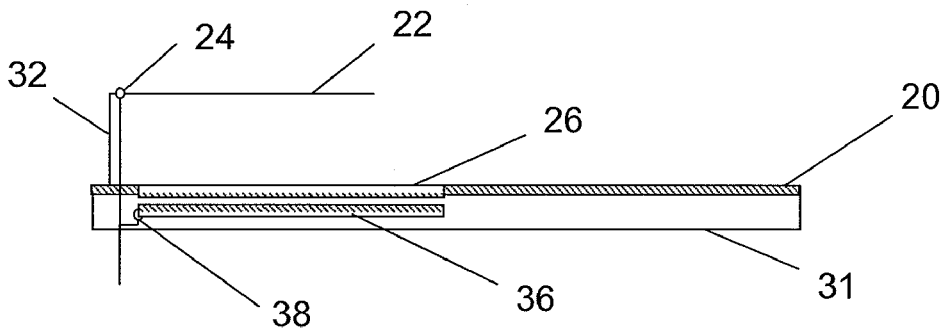
FIG. 5 shows a sectional view of parts of an antenna arrangement according to a second embodiment of the present invention with an alternative second radiating magnetic antenna element.

The slot used can be a cavity backed slot. An example of a second embodiment using such a solution is shown in FIG. 5, which shows a sectional view of an antenna arrangement 18 on a substrate 31. Here there is provided a cavity 36 in the substrate 31 underneath the slot 26. The slot 26 is here capacitively fed by the cavity 36. Thus here the connection points 38 for the slot 26 (of which only one is shown) are provided to the cavity 36 and not directly to the slot 26.

Figure 6:
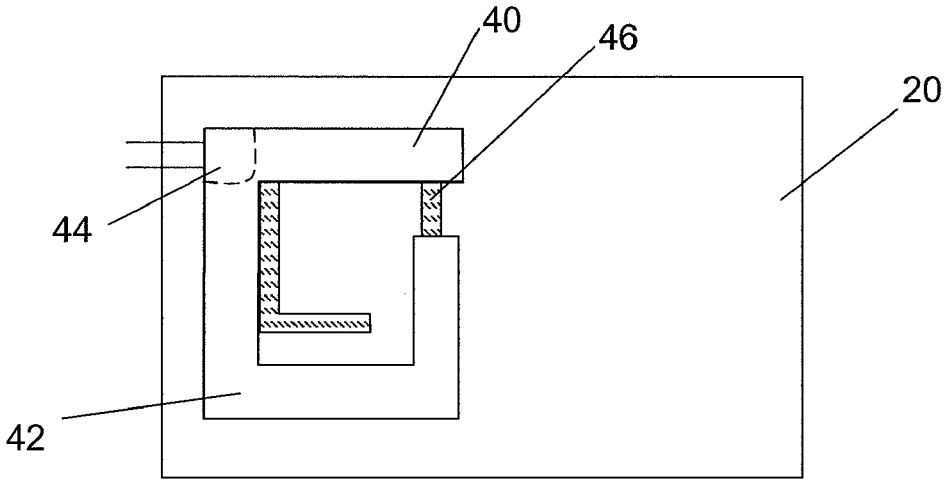
FIG. 6 shows a top view of an antenna arrangement according to a third embodiment of the present invention including a first radiating electrical antenna element provided above a ground plane including a second radiating magnetic antenna element.
Figure 7:
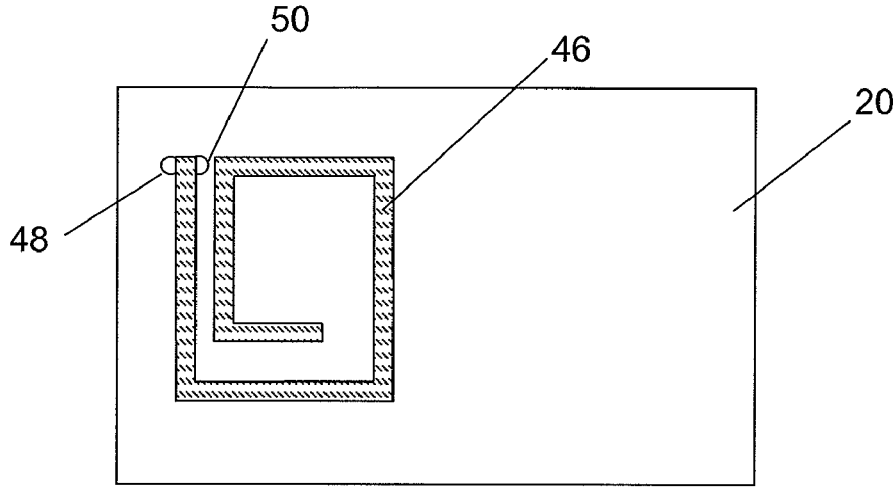
FIG. 7 shows a top view of the antenna arrangement according to the third embodiment but without the first radiating electrical antenna element.

It is possible to apply the concept of the present invention also on multi-resonating antenna elements. One such example according to a third embodiment of the present invention is shown in FIGS. 6 and 7, which shows a multi resonating antenna arrangement 18 with a PIFA element (FIG. 6) and without the PIFA element (FIG. 7) in views that are similar to the views of FIGS. 2 and 3. Here the PIFA element includes a feeding section 44 with connections to ground and the radio circuit. The feeding section 44 is also connected to a first 40 and a second 42 branch. Each branch 40 and 42 is dimensioned for resonating at a frequency in one frequency band, where the second 42 may be resonating in the 850 MHz band and the first 40 may be resonating in the 1800 MHz band. The slot 46 is in this third embodiment provided in the ground plane 20 as before and is preferably contained within a volume between the first radiating antenna element and ground. Here the slot 46 is provided as a number of straight sections which are joined to each other by a number of bends, which bends may be 90-degree bends as is shown in FIG. 7. A first straight section leads from the feeding point provided by two connection points 48 and 50 to a first bend. The length of this first section is here dimensioned after the highest resonating frequency, while the whole length of the slot is dimensioned after the lowest resonating frequency, where the further bends provide enhanced wideband properties. The resonating frequencies of the slot 26 are here the same as the resonating frequencies of the PIFA element.

It should here be realised that the branches of the PIFA antenna element may be configured in numerous ways. There may furthermore be provided a passive branch which excites the branch provided for highest resonating frequency in order to improve the wideband properties. Also the slot may have more or fewer bends. It should also be realised that this third embodiment may be varied through using a cavity backed slot as described in relation to the second embodiment.

Figure 8:
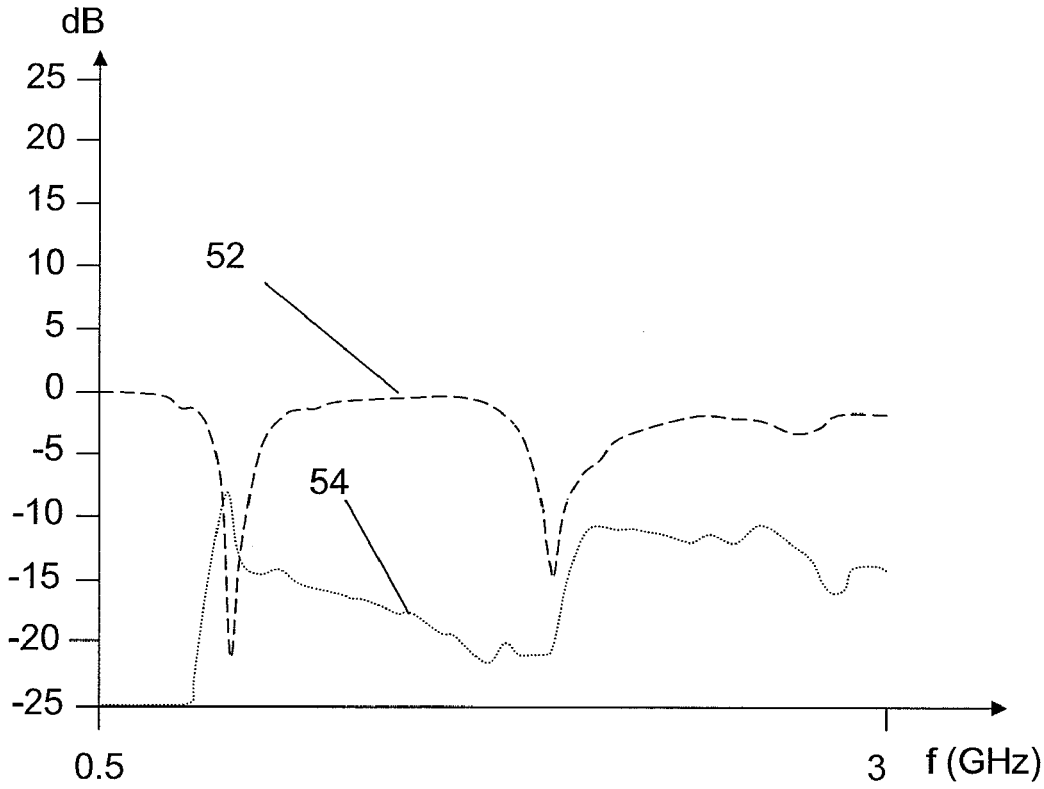
FIG. 8 shows plots of VSWR and isolation for an antenna arrangement according to the third embodiment.

A plot of the VSWR 52 (Voltage Standing Wave Ratio) and isolation 54 (expressed in dB) of an antenna arrangement according to the principles of the third embodiment for a frequency range of 0.5-3 GHz is shown in a curve in FIG. 8. As can be seen the antenna arrangement provides good characteristics for a wide frequency range covering the two resonance frequencies and the bands they are provided in, i.e.

covering the 850 and 1800 MHZ bands and also has good isolation in this range, which enables the use of the antenna for diversity applications.

It should here be realised that it is also possible to add a third radiation antenna element, which may be another slot antenna. This may be done through bending a part of the ground plane so that the ground plane has two sections, a first which is provided under the first radiating antenna element and being parallel with the plane in which this first radiating antenna element is provided. The second radiating antenna element is here of course also provided in this section. The second section is then bent so that it is perpendicular or essentially perpendicular to the first section and in this second section a third radiating magnetic antenna element is provided. If this third radiating magnetic antenna element is a slot, this slot would then be directed away from the first and second radiating antenna elements, i.e. the opening of the slot would be facing away from the antenna volume provided by the PIFA element and ground plane. In this way it is possible to provide three radiating antenna elements that have limited influence on each other and in a small space.

The first radiating electrical antenna element is not limited to PIFA elements. Other types of electrical dipole elements may be provided. There may for instance be provided two normal dipole elements instead that are bent so that they are provided in a plane parallel with the ground plane. It is also possible with a monopole element that is bent in the same way. The element may also be patch and can have any suitable shape. The second radiating magnetic antenna element is with advantage a magnetic dipole element and has here been described in relation to a slot. However, also other magnetic dipoles are possible.

These are just some of the modifications that are possible to make of the present invention. Therefore it should be realised that the present invention is only to be limited by the following claims.

The invention claimed is:

1. An antenna arrangement for use in a communication device, comprising:

a ground plane;

a radiating electrical antenna element provided in a plane arranged at a distance from and parallel to at least a portion of the ground plane, the radiating electrical antenna element being dimensioned to resonate at at least one frequency; and a radiating magnetic antenna element provided in the ground plane apart from the radiating electrical antenna element and being dimensioned to resonate at the at least one frequency simultaneously with the radiating electrical antenna element.

2. The antenna arrangement of claim 1, where the radiating electrical antenna element is dimensioned to resonate at another frequency.

3. The antenna arrangement of claim 1, where the radiating electrical antenna element comprises an electric dipole element.

4. The antenna arrangement of claim 3, where the electric dipole element is a planar inverted-F antenna (PIFA) antenna element.

5. The antenna arrangement of claim 4, where the radiating electrical antenna element comprises a number of branches connected to a feeding section, wherein at least some of the number of branches are dimensioned for resonating at frequencies that differ.

6. The antenna arrangement of claim 1, where the magnetic radiating antenna element is a magnetic dipole antenna element.

7. The antenna arrangement of claim 6, where the magnetic dipole antenna element is provided as a slot in the ground plane to form a slot antenna element.

8. The antenna arrangement of claim 7, where the radiating magnetic antenna element comprises a straight section provided between a feeding point and a bend, where a distance between the bend and the feeding point corresponds to one resonating frequency of the radiating magnetic antenna element.

9. The antenna arrangement of claim 7, where the radiating magnetic antenna element is a cavity-backed slot antenna.

10. The antenna arrangement of claim 1, where the ground plane comprises:

a first section disposed under the radiating electrical antenna element and parallel to the plane in which the radiating electrical antenna element is provided, and a second section disposed perpendicularly to the first section and including a third radiating magnetic antenna element.

* * * * *